United States Patent [19]

Pooley

[11] Patent Number: 4,723,921

[45] Date of Patent: Feb. 9, 1988

[54] ELECTRICAL CONNECTOR

[75] Inventor: Denis M. Pooley, Markham, Canada

[73] Assignee: AMP Incorporated, Harrisburg, Pa.

[21] Appl. No.: 937,775

[22] Filed: Dec. 4, 1986

[51] Int. Cl.[4] ..... H01R 11/01

[52] U.S. Cl. ..... 439/783; 439/784; 439/794; 439/863

[58] Field of Search ..... 339/247, 248 R, 248 S; 439/249, 273 R, 274

[56] References Cited

U.S. PATENT DOCUMENTS

| | | | |
|---|---|---|---|
| 1,466,735 | 9/1923 | Williams | 339/248 R |
| 2,106,724 | 2/1938 | Cope | 339/273 R |
| 3,065,452 | 11/1962 | Osborn | 339/274 |
| 3,462,543 | 8/1969 | Wahlet et al. | 339/247 |
| 4,279,461 | 7/1981 | Bussen et al. | 339/247 |
| 4,533,205 | 8/1985 | Frank | 339/247 |
| 4,600,264 | 7/1986 | Counsel | 339/249 R |
| 4,643,512 | 2/1987 | Prodel | 339/248 R |

*Primary Examiner*—Gil Weidenfeld
*Assistant Examiner*—P. Austin
*Attorney, Agent, or Firm*—Allan B. Osborne

[57] ABSTRACT

An electrical connector for electrically connecting two conductors. More particularly, the conductor includes a C-shaped body member having parallel, inwardly facing channels for receiving conductors therein and a pair of toggle blocks pivotally engaging each other and each having outwardly facing channels along one side. The toggle blocks, having a combined width greater than the space between conductors positioned in the channels in the C-shaped body member, compress the conductors therein when forced into the body member.

5 Claims, 4 Drawing Figures

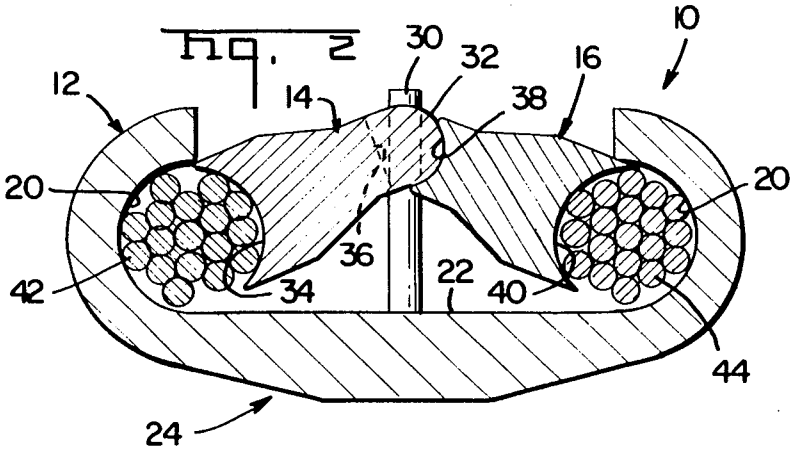
Fig. 2
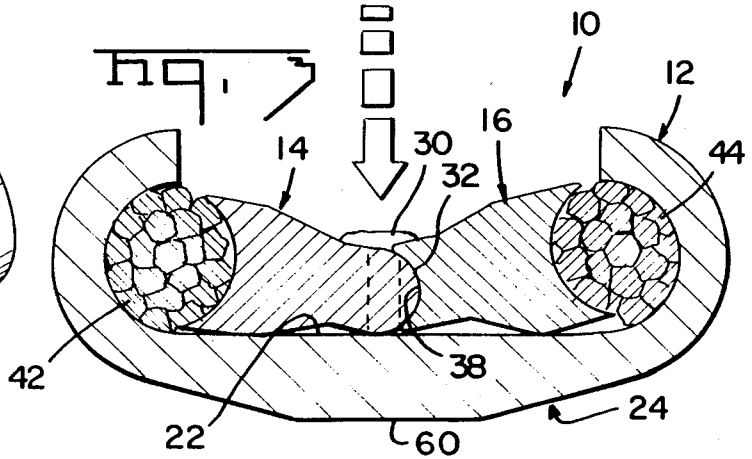
Fig. 3
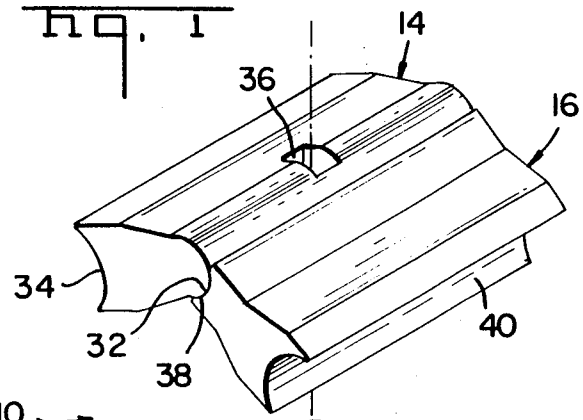
Fig. 1
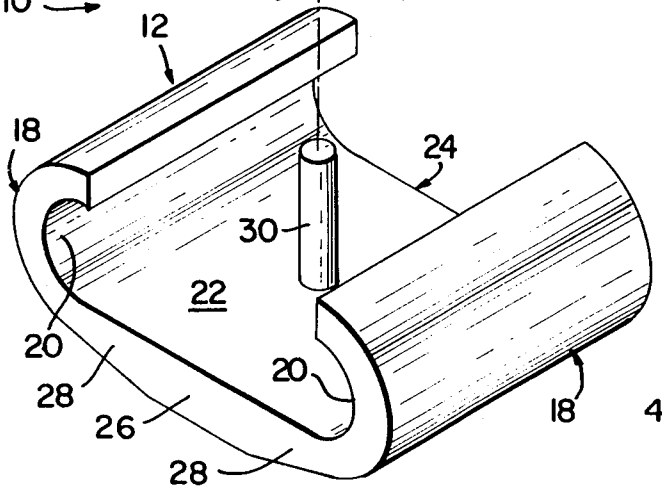

ELECTRICAL CONNECTOR

FIELD OF THE INVENTION

This invention relates to an electrical connector for electrically and mechanically connecting two conductors together. More particularly, the connector is of the type including a C-shaped member and toggle blocks which compress the conductors into parallel channels in the C-shaped member.

BACKGROUND OF THE INVENTION

Electrical connectors of the type having a C-shaped body member having converging channels and a complementary wedge member have been known from at least as early as Apr. 21, 1931 when U.S. Pat. No. 1,801,277 issued to W. G. Kelley on an application filed May 18, 1926. Subsequent thereto a large number of patents disclosing different and improved embodiments have issued, including more recently U.S. Pat. Nos. 4,415,222 and 4,600,264. In each of the disclosures, the basic Kelley concept was followed; i.e., two conductors are electrically and mechanically connected by being pressed into and against interior curved surfaces or channels provided in a C-shaped body member by a wedge being driven longitudinally into the body member between the conductors.

It is now proposed to provide an electrical connector wherein the conductors are forced into parallel channels in a C-shaped body member by a pair of toggle blocks being pressed into the body member in a direction normal to the longitudinal axis.

SUMMARY OF THE INVENTION

According to the invention, an electrical connector is provided which includes an elongated, C-shaped body member having parallel, inwardly facing, conductor-receiving channels along each longitudinal side and a pair of toggle block pivotally engaging each other along one side which have a combined width greater than the space between conductors positioned in the channels so that upon forcing the toggle blocks into the body member, the conductors are mechanically gripped and electrically interconnected.

BRIEF DESCRIPTION OF THE DRAWINGS

FIG. 1 is an exploded, perspective view of the electrical connector of the present invention showing the components thereof;

FIGS. 2 and 3 are sectional views taken normal to the connector axis illustrating the connection of electrical conductors therein.

DESCRIPTION OF THE INVENTION

Figure 4:
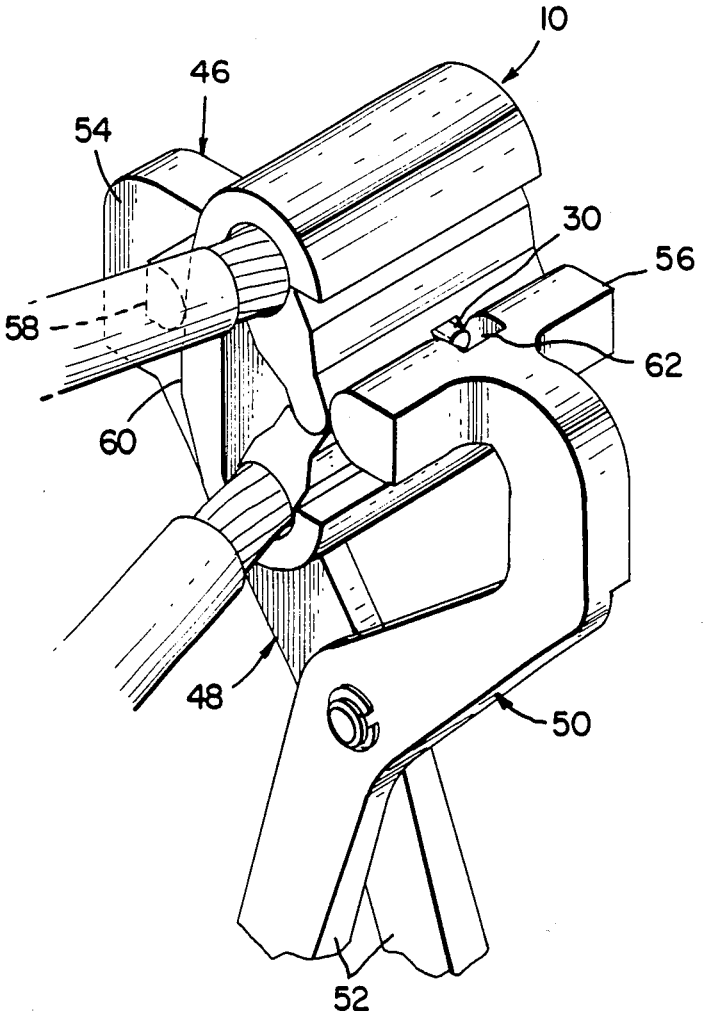
FIG. 4 is a perspective view of a tool used in conjunction with the electrical connector.

With reference to FIG. 1, the components of electrical connector 10 include C-shaped body member 12 and a pair of toggle blocks 14, 16. Preferrably, body member 12 and toggle blocks 14, 16 are made from 6061-T-6 aluminum.

C-shaped body member 12 is preferrably extruded with the longitudinal edges rolled over to define channel portions 18 and to provide parallel, interior curved channels 20. Channels 20 face each other across surface 22 of wall 24 which join channel portions 18. Channels 20 are dimensioned to conformably receive a range of conductor sizes; e.g., from 795 26/7 ACSR to 636-37 AAC.

Wall 24 of body member 12 is thickest along a longitudinally extending middle portion 26 relative to parallel side portions 28 which are between and joins middle portion 26 and channel portions 18. As shown, the thickness of side portions 28 decreases outwardly from middle portion 26. The outward thinning of side portion 28 facilitates outward flexing of channel portions 18. Pin 30 is mounted in wall 24 in the center of body member 12 and projects outwardly from wall surface 22.

Toggle block 14 includes an exterior curved or convex pivoting surface 32 extending along one longitudinal side and an outwardly facing, conductor-receiving channel 34 extending along the opposite longitudinal side. Hole 36 is provided in block 14 adjacent surface 32 and intermediate the ends.

Toggle block 16 includes an interior curved or concave pivoting surface 38 extending along one longitudinal side and an interior curved, or outwardly facing, conductor-receiving channel 40 extending along the opposite longitudinal side.

Channels 34, 40 on toggle blocks 14, 16 respectively are dimensioned to cooperate with channels 20 in body member 12 in confining and compressing conductors therebetween.

As indicated in the drawings, pivoting surfaces 32, 38 on blocks 14, 16 respectively conformably engage each other in the same manner as a ball and socket joint.

Toggle blocks 14, 16 are sized so that their combined width is greater than the space between conductors positioned in respective channels 20 in body member 12. The excess width is such that upon pushing blocks 14, 16 into that space, the conductors are compressed and mechanically gripped and, by reason of the conductivity of body member 12 and toggle blocks 14, 16, are electrically interconnected.

Blocks 14, 16 are preferrably made by well known casting techniques.

Pin 30 is preferrably made from a malleable material such as aluminum.

In use, bared sections of conductors 42, 44 are positioned in respective channels 20 in body member 12 as shown in FIG. 2. Toggle blocks 14, 16 are added as shown; i.e., channels 34, 40 are abutting conductors 42, 44 respectively, pivoting surfaces 32, 38 are in engagement with each other and pin 30 extends through hole 36 in block 14. Toggle blocks 14, 16 are then pressed in towards surface 22 of wall 24 of body member 12. As blocks 14, 16 move down into the space between conductors 42, 44 as shown in FIG. 3, conductors 42, 44 are compressed between respective channels 20 and channels 34, 40 to complete the mechanical gripping and electrically interconnection. Pin 30 may be mushroomed over toggle blocks 14, 16 as shown to secure the blocks 14, 16 in body member 12 although this is not necessary since toggle blocks 14, 16 are pushed over center and are locked in position. To the extent required by the dimensions of conductors 42, 44, channel portions 22 are resiliently spread apart which insures continued compressive forces on conductors 42, 44 even in the event of conductor creep, a well known phenomenon experienced by aluminum cables and wires.

During the compression of conductors 42, 44, the individual strands rub against each other and oxides and dirt are wiped therefrom to enhance the electrical connection. Further, the connection is gas tight, which reduces the incident of corrosion.

Plier-type tool 46 shown in FIG. 4 illustrates a suitable means for pressing toggle blocks 14, 16 into the position shown in FIG. 3 and also for mushrooming pin 30. Tool 46 includes two members 48, 50 with each having handle 52 at one end (only a segment thereof being shown) and jaws 54, 56 respectively at the other end. Members 48, 50 are pivotally pinned together so that by closing handles 52, jaws 54, 56 move in towards each other. Jaw 54 has a flat surface 58 which abuts surface 60 on wall 24 of body member 12. Jaw 56 is T-shaped and includes notch 62 therein. The depth of notch 62 is such that the free end of pin 30 abuts the floor thereof just before toggle blocks 14, 16 are completely pressed into body member 12. During the final travel, pin 30 is mushroomed as shown in FIG. 3 to secure blocks 14, 16.

As can be discerned, an electrical connector for electrically connecting two conductors has been disclosed. The connector includes a C-shaped body member having parallel, facing conductor receiving channels and a pair of pivotally engaging toggle blocks which are received in the body member between the channels. The combined width of the toggle blocks exceed the space between conductors positioned in the channels so that they are compressed and mechanically gripped upon forcing the toggle blocks therebetween. The conductivity of the body member and toggle blocks provide an electrical interconnection between the conductors.

I claim:

1. An electrical connector for electrically connecting two electrical conductors, said connector comprising:

conductive, elongated, C-shaped body means having parallel, inwardly facing conductor-receiving channel means on each longitudinal side of and attached to intervening wall means; and a pair of conductive toggle block means pivotally engaging each other along one side and each having outwardly facing, conductor-receiving channel means on an opposite side, said toggle block means having a combined width greater than the space between conductors disposed in respective said channel means in said body means, said toggle block means adapted to be forced into said body means with said outwardly facing channel means facing and cooperating with respective said channel means in said body means to grip and electrically interconnect conductors which may be disposed therebetween.

2. The electrical connector of claim 1 wherein one of said toggle block means includes a concave surface extending along one longitudinal side and the other of said toggle block means includes a convex surface extending along one longitudinal side and with said convex surface conformably and pivotally received in said concave surface.

3. The electrical connector of claim 1 wherein said intervening wall means includes a longitudinal extending middle portion and longitudinally extending side portions intermediate said middle portion and said channel means, said side portions thinning outwardly from said middle portion to said channel means whereby said channel means may be resiliently spread apart from each other.

4. The electrical connector of claim 1 further including securing means for securing said toggle block means in said C-shaped body means.

5. The electrical connector of claim 4 wherein said securing means includes a pin extending outwardly from said C-shaped body member intermediate said channel means and one of said toggle block means includes a hole extending therethrough for passage of said pin, said pin having a free end adapted to be mushroomed over at least one of said toggle block means.

* * * * *